US008353271B2

(12) United States Patent
Nishi et al.

(10) Patent No.: US 8,353,271 B2
(45) Date of Patent: Jan. 15, 2013

(54) ENGINE SPEED CONTROL SYSTEM FOR WORK VEHICLE

(75) Inventors: Eiji Nishi, Kawachinagano (JP); Nobuyuki Okabe, Izumi (JP); Kenji Yoshikawa, Osaka (JP)

(73) Assignee: Kubota Corporation, Osaka (JP)

( * ) Notice: Subject to any disclaimer, the term of this patent is extended or adjusted under 35 U.S.C. 154(b) by 980 days.

(21) Appl. No.: 12/402,168

(22) Filed: Mar. 11, 2009

(65) Prior Publication Data

US 2009/0293840 A1 Dec. 3, 2009

(30) Foreign Application Priority Data

May 29, 2008 (JP) ..... 2008-141214
May 29, 2008 (JP) ..... 2008-141215
May 29, 2008 (JP) ..... 2008-141216
May 29, 2008 (JP) ..... 2008-141217

(51) Int. Cl.
*F02D 28/00* (2006.01)

(52) U.S. Cl. ..... 123/350; 123/361

(58) Field of Classification Search ..... 123/350, 123/361

See application file for complete search history.

(56) References Cited

U.S. PATENT DOCUMENTS

| | | | | |
|---|---|---|---|---|
| 5,389,051 | A | 2/1995 | Hirate et al. | |
| 6,009,367 | A * | 12/1999 | Hori et al. | 701/93 |
| 8,175,790 | B2 * | 5/2012 | Stemler et al. | 701/110 |
| 2010/0180862 | A1 * | 7/2010 | Kim | 123/350 |
| 2010/0186713 | A1 * | 7/2010 | Kawaguchi et al. | 123/350 |
| 2010/0192907 | A1 * | 8/2010 | Stemler et al. | 123/350 |

FOREIGN PATENT DOCUMENTS

| | | | |
|---|---|---|---|
| JP | 01195933 | | 8/1989 |
| JP | 3275960 | A | 12/1991 |
| JP | 9168312 | A | 6/1997 |
| JP | 2006299902 | A | 11/2006 |
| JP | 2007170217 | A | 5/2007 |
| KR | 20000007996 | A | 2/2000 |

* cited by examiner

*Primary Examiner* — Erick Solis
(74) *Attorney, Agent, or Firm* — The Webb Law Firm

(57) ABSTRACT

An engine speed control system for a work vehicle is disclosed. Storage means (56) stores a predetermined engine speed. A manually operated input device (37, 38) issues an instruction to retrieve the engine speed from the storage means (56). Engine speed control means (50) executes a constant speed control, whereby the engine speed stored in the storage means (56) is set as a target speed on the basis of a first input operation made using the input device (37, 38). The engine speed control means (50) further executes a stored speed change control for allowing the setting of the engine speed stored in the storage means (56) to be changed based on a second, different input operation performed using the input device (37, 38).

5 Claims, 4 Drawing Sheets

ENGINE SPEED CONTROL SYSTEM FOR WORK VEHICLE

BACKGROUND OF THE INVENTION

1. Field of the Invention

The present invention relates to an engine speed control system for a work vehicle, comprising a manually operated input device for issuing an instruction to retrieve an engine speed from storage means for storing a predetermined engine speed; and engine speed control means for executing a constant speed control whereby the engine speed stored in the storage means is set as a target speed based on a first input operation performed using the input device.

2. Description of the Related Art

There is known from JP 1-195933 A, an example of an engine speed control system of the above description. This system comprises a preset acceleration setting device for enabling an engine speed setting stored in storage means to be changed. Based on an output of the preset acceleration setting device, control means executes a stored speed change control that allows the setting of the engine speed stored in the storage means to be changed.

In the prior art system, however, the operating device for issuing an instruction for the control means to change the setting of the engine speed stored in the storage means is not the same as the device for issuing an instruction to retrieve the engine speed stored in the storage means. Accordingly, the operational configuration used to control the engine speed is complicated, prompting a need for the configuration to be simplified.

SUMMARY OF THE INVENTION

It is an object of the present invention to provide an engine speed control system that not only enables a simpler operational configuration to be adopted, but allows the engine speed to be controlled while changing the setting of the engine speed stored in storage means.

In order to accomplish the aforesaid object, the engine speed control system for a work vehicle of the present invention comprises a manually operated input device for issuing an instruction to retrieve an engine speed from storage means for storing a predetermined engine speed, and engine speed control means for executing a constant speed control whereby the engine speed stored in the storage means is set as a target speed based on a first input operation used on the input device; wherein the engine speed control means executes a stored speed change control that allows the setting of the engine speed stored in the storage means to be changed.

According to this configuration, the manually operated input device has a function for issuing an instruction for the engine speed control means to execute the constant speed control, and a function for issuing an instruction for the engine speed control means to execute the aforedescribed stored speed change control. Furthermore, the fact that the manually operated input device has the two interrelated functions described above makes the engine speed control less complex. As a result, the engine speed control system according to the present invention makes it possible to perform the stored speed change control using a simplified operational configuration.

As a preferred embodiment of the present invention there is proposed an aspect wherein the engine speed control means changes the engine speed stored in the storage means based on the operation of the input device in the stored speed change control. According to this aspect the input device has a function for issuing an instruction for the engine speed control means to execute the constant speed control, and a function for issuing an instruction for the control means to execute the stored speed change control, while also functioning as an operative device for changing the engine speed stored in the storage means in the stored speed change control. Furthermore, the fact that the input device has these three interrelated functions further reduces the complexity of the engine speed control.

As a preferred embodiment of the present invention, the input device comprises a first momentary switch and a second momentary switch, wherein a first engine speed corresponding to the first momentary switch and a second engine speed corresponding to the second momentary switch are stored in the storage means; the first input operation is a brief pressing of the momentary switch within a set period of time, and the second input operation is a long pressing of the momentary switch that exceeds the set period of time; and the engine speed control means executes the controls described below:

(1) as the constant speed control, a first constant speed control for setting the first engine speed to a target engine speed on the basis of the brief pressing of the first momentary switch;

(2) as the constant speed control, a second constant speed control for setting the second engine speed to a target engine speed on the basis of the brief pressing of the second momentary switch;

(3) as the stored speed change control, a first stored speed change control for allowing the setting of the first engine speed stored in the storage means to be changed on the basis of the long pressing of the first momentary switch; and (4) as the stored speed change control, a second stored speed change control for allowing the setting of the second engine speed stored in the storage means to be changed on the basis of the long pressing of the second momentary switch; and that in either of the first stored speed change control or the second stored speed change control, the engine speed control means increases the associated target engine speed on the basis of the operation of the first momentary switch, and reduces the associated target engine speed on the basis of the operation of the second momentary switch.

In accordance with this configuration, the operating of a first momentary switch enables the vehicle body to be made to travel in a constant speed state (hereinafter referred to as the "first stored constant speed state") according to the first engine speed (hereinafter referred to as the "first stored speed") stored in the storage means.

The operating of a secondary momentary switch enables the vehicle body to be made to travel in a constant speed state (hereinafter referred to as the "second stored constant speed state") according to the second engine speed (hereinafter referred to as the "second stored speed") stored in the storage means by operating a second momentary switch.

In other words, it is possible to obtain two types of constant speed states; i.e., the first stored constant speed state and the second stored constant speed state. Accordingly, a constant speed state for puddling work and a constant speed state for tilling work can be obtained in a simple manner by operating the momentary switches if the first stored constant speed state is used for puddling work, and the second stored constant speed state is used for tilling work. In addition, a constant speed state for work and a constant speed state for headland turning can be obtained in a simple manner by operating the momentary switches when the first stored constant speed state is used for work and the second stored constant speed state is used for headland turning.

The first momentary switch has a function for issuing an instruction for the control means to execute the first constant speed control, a function for issuing an instruction for the control means to execute the first stored speed change control, and a function as an operative device for prompting a change to a direction for increasing the engine speed stored in the storage means in the first stored speed change control and the second stored speed change control. The second momentary switch has a function for issuing an instruction for the control means to execute the second constant speed control, a function for issuing an instruction for the control means to execute the second stored speed change control, and a function as an operative device for prompting a change to a direction for reducing the engine speed stored in the storage means in the first stored speed change control and the second stored speed change control. This makes it easier to change the settings of the first and second stored speeds as compared to, e.g., using a short press of the first momentary switch to prompt a change toward a direction for increasing the first stored speed, and using a long press to prompt a change toward a direction for reducing the first stored speed; or using a short press of the second momentary switch to prompt a change toward a direction for increasing the second stored speed, and using a long press to prompt a change toward a direction for reducing the second stored speed.

In other words, instead of having one dedicated operative device, it is possible to have a dedicated operative device for prompting a change toward a direction for increasing the engine speed stored in the storage means and a dedicated operative device for prompting a change toward a direction for reducing the engine speed stored in the storage means.

It is accordingly possible to simplify the operational configuration and improve ease of use, while also allowing switching between the first stored constant speed state and the second stored constant speed state according to the work to be performed or other factors.

According to another preferred embodiment in either of the first stored speed change control or the second stored speed change control:

(1) when the first momentary switch is briefly pressed, the engine speed control means increases the associated target engine speed by a predetermined amount;

(2) when the second momentary switch is briefly pressed, the engine speed control means reduces the associated target engine speed by a predetermined amount;

(3) when the first momentary switch is pressed for a long period, the engine speed control means continuously increases the associated target engine speed over the period that the operation is uninterruptedly performed; and (4) when the second momentary switch is pressed for a long period, the engine speed control means continuously reduces the associated target engine speed over the period that the operation is uninterruptedly performed.

According to this configuration, the momentary switches are operated correspondingly for cases when the engine speed stored in the storage means is to be changed by a small or large amount, affording reliable operation.

According to another preferred aspect, a control whereby the engine speed stored in the storage means is set as a target speed is carried out in the case that the engine speed stored in the storage means is less than an upper limit speed set in advance; and a control whereby the upper limit speed is set as the target speed is carried out in the case that the engine speed stored in the storage means is greater than the upper limit speed.

In accordance with this configuration, the vehicle body can be made to travel in the upper limit constant speed state in which the speed is less than the stored constant speed state by operating the upper limit setting device so that the upper limit speed is less than the stored speed in the stored constant speed state. It is possible to easily return to a stored constant speed state by operating the upper limit setting device so that the upper limit speed becomes greater than the stored speed in the upper limit constant speed state. In other words, the constant-speed rotation can be finely adjusted by operating the upper limit setting device with reference to the stored speed, and fine adjustment of the constant-speed rotation that corresponds to the field conditions or the like can thereby be carried out in a simple manner by operating the upper limit setting means in the case that the stored constant speed state is used for work. Also, the degree of slippage can be reduced to increase the gripping force, and it is possible to easily escape from the slippage state by operating the upper limit setting device so that the upper limit speed becomes less than the stored speed in the case that slippage has occurred in the stored constant speed state. It is possible to easily return to the stored constant speed state by operating the upper limit setting means so that the upper limit speed becomes greater than the stored speed following escape from the slippage state. Therefore, it is possible to easily perform an escape operation in the case the slippage has occurred during travel in the stored constant speed state, to return to a constant speed state following the escape from the slippage state, and to finely adjust the constant-speed rotation that corresponds to field conditions or the like in the stored constant speed state.

Other features and advantages of the present invention will be made apparent below in the description of the embodiments with reference to the diagrams.

DESCRIPTION OF THE PREFERRED EMBODIMENTS

Embodiments in which the engine speed control system of a work vehicle according to the present invention has been applied to a tractor as an example of a work vehicle will be described with reference to the diagrams as examples of a preferred embodiment for implementing the present invention.

Figure 1:
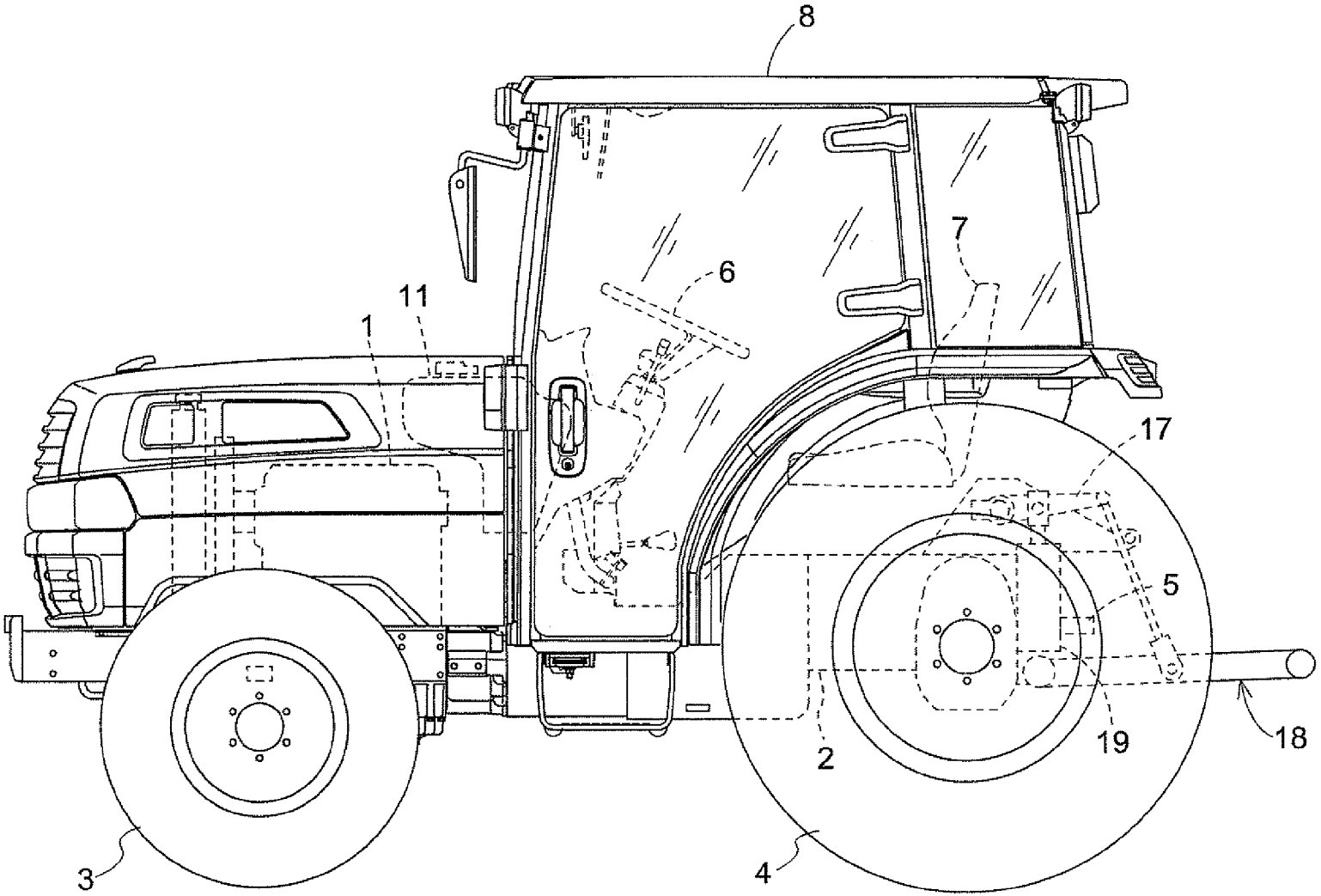
FIG. 1 is a side view of an entire tractor.

FIG. 1 is a side view of an entire tractor. The tractor has an engine 1 mounted in the front section. The rotational power outputted by the engine 1 is transmitted to left and right pairs of front wheels 3 and rear wheels 4 via a clutch (not shown) for interrupting the rotational power, a speed change device (not shown) housed in a transmission case 2 that doubles as a frame, and other components, and to a power take-off shaft 5 disposed so as to protrude toward the rear from the transmission case 2. A steering wheel 6 for steering the front wheels, a drivers seat 7, and the like are disposed in the rear section of the tractor to form a passenger/driver section 8, and a cabin 9 for covering the passenger/driver section 8 is mounted on the rear section of the tractor.

Figure 2:
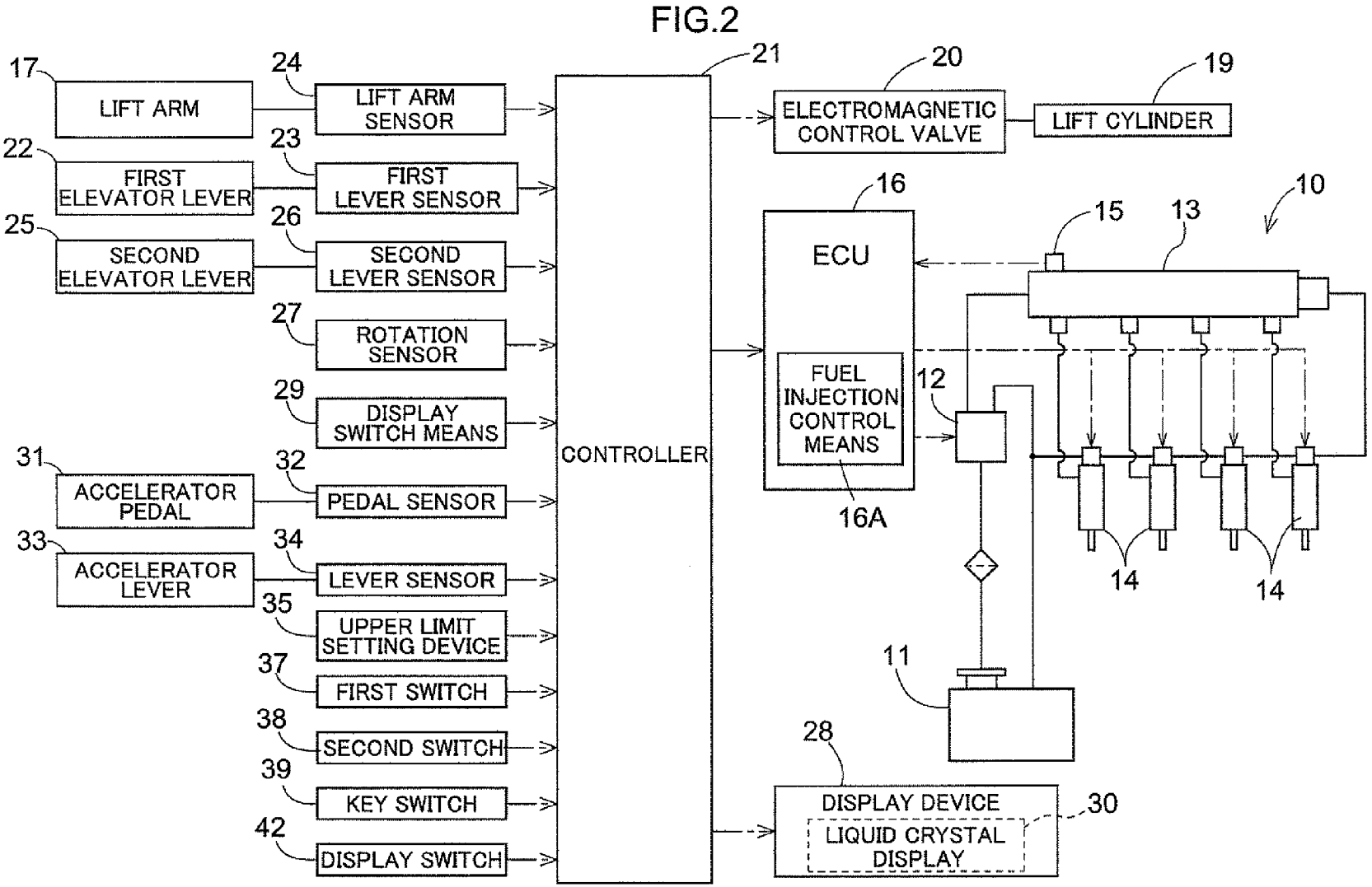
FIG. 2 is a block diagram showing the control system mounted in the tractor.

A common rail fuel injection device 10 for electronically controlling fuel injection timing and quantity is provided to the engine 1, as shown in FIG. 2. The fuel injection device 10 is provided with a supply pump 12 for pumping fuel held in a fuel tank 11; a common rail 13 for accumulating pumped fuel; a plurality of injectors 14 for injecting accumulated fuel into a fuel chamber (not shown); a pressure sensor 15 for detecting pressure inside the common rail 13; an engine control unit (hereinafter abbreviated to ECU) for controlling the actuation of the supply pump 12, the injectors 14, and other components on the basis of output from the pressure sensor 15 and the like; and other components.

The rear section of the transmission case 2 is provided with a left and right pair of lift arms 17, a link mechanism 18 for connecting implements, and a left and right pair of lift cylinders 19 for slidably driving the left and right lift arms 17 in the vertical direction, as well as other components, as shown in FIG. 1. A rotary tiller, a plow, and various other implements (not shown) can be elevatably or elevatably and rollably interchanged in accordance with the type of work.

A single-acting hydraulic cylinder is used as the left and right lift cylinders 19. The left and right lift cylinders 19 retractably operate when the flow of a hydraulic fluid to the cylinders is controlled by the operation of an electromagnetic control valve 20.

Figure 3:
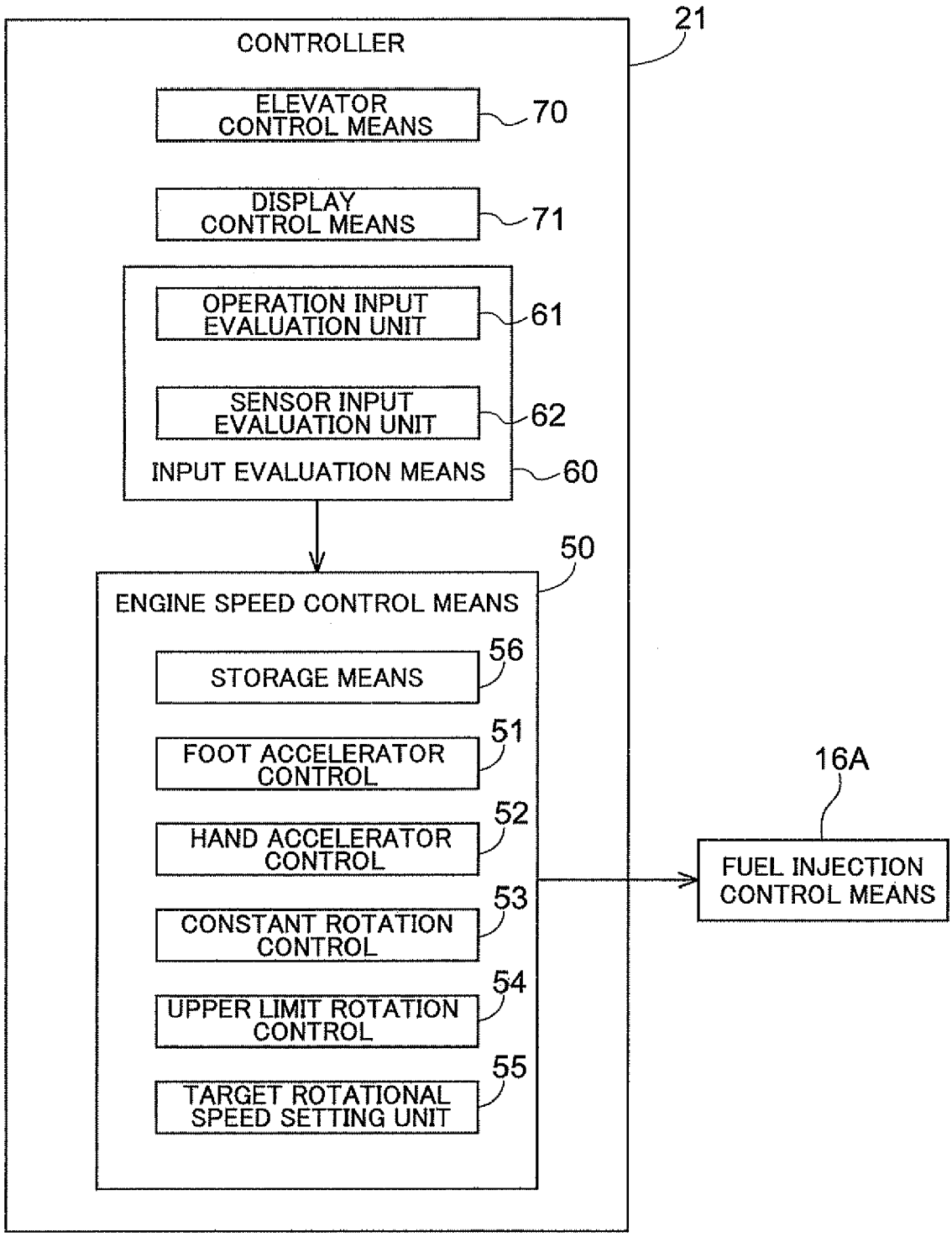
FIG. 3 is control block diagram of the engine speed control system.

A controller 21 composed of a microcomputer is mounted in the tractor, as shown in FIGS. 2 and 3. Input evaluation means 60 for evaluating various input sins and generating required control commands, control parameters, and the like is provided to the controller 21. The input evaluation means 60 includes an operation input evaluation unit 61 for evaluating operation signals from a switch or another input device that is directly operated by a users and a sensor input evaluation unit 62 for evaluating detection signals from various sensors.

An elevator control device 70 for controlling the elevation of an implement is provided as a control program to the controller 21.

The elevator control device 70 performs position control for positioning the implement in a position of any height, forcible elevator control for forcibly elevating the implement to the upper limit position, as well as other types of control.

In the position control, the operation of the electromagnetic control valve 20 is controlled and the left and right lift cylinders 19 are retractably operated so that the output of a lift arm sensor 24 corresponds to the output of a first lever sensor 23 (falls within the width of the dead zone of the output of the first lever sensor 23) on the basis of the output of the first lever sensor 23 for detecting the operative position of the first elevator lever 22, the output of the lift arm sensor 24 for detecting the vertical pivot angle of the lift arms 17, and the map data for elevating/lowering that corresponds to the above outputs.

The forcible elevator control is carried out with priority given to other elevator control in the case that a second lever sensor 26 for detecting the operation of a second elevator lever 25 detects an operation upward from an intermediate position of the second elevator lever 25. In forcible elevator control, the operation of the electromagnetic control valve 20 is controlled and the left and right lift cylinders 19 are extended and operated so that the output of the lift arm sensor 24 corresponds to the elevation upper limit value (falls within the width of the dead zone of the upper limit value of the elevation) on the basis of the output of the lift arm sensor 24 and the preset elevation upper limit value. When the second lever sensor 26 detects a downward operation from the intermediate position of the second elevator lever 25 after the forcible elevator control, the operation of the electromagnetic control valve 20 is controlled and the left and right lift cylinders 19 are retractably operated so that the output of the lift arm sensor 24 corresponds to the output of the first lever sensor 23 (falls within the width of the dead zone of the output of the first lever sensor 23) on the basis of the output of the first lever sensor 23, the output of the lift arm sensor 24, and the map data for elevation. Forcible elevator control is ended thereafter.

In the map data for elevation, the output of first lever sensor 23 is used as the target height position of the implement, the output of the lift arm sensor 24 is used as the actual height position of the implement, and the outputs are correlated.

In other words, the elevator control device 70 carries out arbitrary elevation control on the basis of the operation of the first elevator lever 22, whereby the implement can be elevated or lowered to any height position that corresponds to the operative position of the first elevator lever 22.

The elevator control device 70 carries out forcible elevator control on the basis of the operation of the second elevator lever 25, whereby the implement can be automatically elevated to an elevation upper limit position that corresponds to the preset elevation upper limit value, and the implement can be automatically lowered to any height position that corresponds to the operative position of the first elevator lever 22.

Therefore, in the case that, for example, a rotary tiller or another implement is connected to the rear portion of the tractor to perform tilling work, the height position of the implement is arbitrarily set to perform tilling work so that a desired tilling depth can be obtained by operating the first elevator lever 22; and when a headland turn for changing the direction of the vehicle body is started at the edge of the field during tilling work, the implement can be elevated in a simple manner to the upper limit position by operating the second elevator lever 25 in the upward direction. As a result it is possible to easily avoid the occurrence of a problem in which the inside of the turn is tilled because the implement turns while making contact with the ground. Also, the implement can be lowered in a simple manner to any work height position set by the operation of the first elevator lever 22. This is achieved by operating the second elevator lever 25 in the downward direction immediately prior to the end of headland turning. As a result, tilling work can be restarted at the end of a headland turn.

The first elevator lever 22 is a forward/rearward sliding-type position-holding lever disposed on the right side of the drivers seat 7. The second elevator lever 25 is a vertical sliding-type neutral return lever disposed to the right and below a steering wheel 6. A rotary potentiometer is used as the first lever sensor 23 and the lift arm sensor 24. A switch is adopted for the second lever sensor 26 and is provided with a first contact point in which the lever is closed in coordination with the upward operation of the second elevator lever 25, and a second contact point in which the lever is closed in coordination with the downward operation of the second elevator lever 25.

The controller 21 has a display control means 71 as a control program for displaying, based on the output of an electromagnetic pickup-type rotary sensor 27 for detecting the output speed of the engine 1, the output speed of the engine 1 and other information on a liquid crystal monitor 30 as a display device for a display panel 28 provided to the passenger/driver section 8. The display control means 71 selectively displays an hour meter, remaining fuel, and the like, as well as the gear position, vehicle speed, and information related to the vehicle speed on the liquid crystal monitor 30 on the basis of the operation or the like of a display switch 29 disposed in the vicinity of the display panel 28.

The controller 21 is furthermore provided with engine speed control means 50 as a control program. The engine speed control means 50 has a foot accelerator controller 51 for carrying out foot accelerator control brought about by operation of the accelerator pedal 31, a hand accelerator controller 52 for carrying out hand accelerator control brought about by operation of the accelerator lever 33, a constant speed controller 53 for carrying out constant speed control in which a predetermined engine speed stored in storage means 56 is used as a target speed on the basis of the user operation of switches 37, 38 as a manually operated input device, an upper limit rotation controller 54 for carrying out upper limit rotation control to limit the engine speed to an upper limit speed set by an upper-limit setting device 35 that functions as upper limit setting means for setting the upper limit of the engine speed, and a target speed setting unit 55 for setting the ultimate target speed of the engine 1 in cooperation with the controllers described above.

The engine speed control means 50 is also provided with a first map data in which the engine speed and the output of the pedal sensor 32 for detecting the operative position of the accelerator pedal 31 are correlated; a second map data in which the engine speed and the output of a lever sensor 34 for detecting the operative position of the accelerator lever 33 are correlated; a third map data in which the engine speed and the output of the upper-limit setting device 35 for setting the upper limit of the speed are correlated; and other types of data.

The target speed setting unit 55 selects the engine speed corresponding to the output of the pedal sensor 32 (hereinafter referred to as the "pedal-set speed") based on the output of the pedal sensor 32 and the first map data; selects the engine speed corresponding to the output of the lever sensor 34 (hereinafter referred to as the "lever-set speed") based on the output of the lever sensor 34 and the second map data; and selects the engine speed corresponding to the output of the upper-limit setting device 35 (hereinafter referred to as the "upper limit speed") based on the output of the upper-limit setting device 35 and the third map data.

The higher speed among the pedal-set speed and the lever-set speed is set as the target speed when the speed selected among the above is compared and the pedal-set speed and the lever-set speed are less than the upper limit speed. The upper limit speed is set as the target speed when one speed among the pedal-set speed and the lever-set speed is greater than the upper limit speed.

The accelerator pedal 31 is a depressively operated pedal of the initial position return type disposed in the right foot area of the passenger/driver section 8. The accelerator lever 33 is a position-holding lever of the forward/rearward sliding type disposed on the right side of the driver's seat 7. The upper-limit setting device 35 is configured as a dial-type device using a rotary potentiometer or the like.

An ECU 16 is provided with fuel injection control means 16A as a control program for controlling the operation of the supply pump 12, the injectors 14, and the like so that the target speed is obtained as the output speed of the engine 1 on the basis of a target speed set by the target speed setting unit 55 of the controller 21, the output of the rotation sensor 27 inputted by way of the controller 21, and the like.

The engine speed control means 50 operates in cooperation with the fuel injection control means 16A of the ECU 16 and controls the output speed of the engine 1.

The engine speed control means 50 sets the pedal-set speed to the target speed when the pedal-set speed is greater than the lever-set speed in a state in which the pedal-set speed and the lever-set speed are less than the upper limit speed, and carries out foot accelerator control for controlling the output speed of the engine 1 so that the pedal-set speed is obtained as the output speed of the engine 1. Conversely, the engine speed control means sets the lever-set speed as the target speed when the lever-set speed is greater than the pedal-set speed, and carries out hand accelerator control for controlling the output speed of the engine 1 so that the lever-set speed is obtained as the output speed of the engine 1. Also, [the engine speed control means] sets the upper limit speed to the target speed when one speed among the pedal-set speed and the lever-set speed is greater than the upper limit speed, and carries out upper limit rotation control for controlling the output speed of the engine 1 so that the upper limit speed is obtained as the output speed of the engine 1.

In accordance with this configuration, the vehicle body can be made to travel in a lever constant speed state for maintaining the output speed of the engine 1 at the lever-set speed by, e.g., operating the accelerator lever 33 to an arbitrary operative position or by operating the upper limit-setting device 35 so that the upper limit speed does not become less than the lever-set speed. In this lever constant speed state, the accelerator pedal 31 is operated so that the pedal-set speed becomes greater than the lever-set speed, whereby the vehicle body can be made to travel in a pedal acceleration state in which the output speed of the engine 1 is increased from the lever-set speed to the pedal-set speed during the interval in which the accelerator pedal operation has been operated. In the pedal acceleration state, the vehicle body can be made to travel in an upper limit constant speed state, which limits the output speed of the engine 1 to the upper limit speed, when the pedal-set speed becomes greater than the upper limit speed. It is possible to return to the lever constant speed state in a simple manner by cancelling the operation of the accelerator pedal 31.

In other words, high and low two-stage constant speed states, i.e., the lever constant speed state and the upper limit constant speed state can be obtained, and variable speed operation can be arbitrarily carried out across a lever constant speed state and an upper limit constant speed state.

In the lever constant speed state, the vehicle body can be made to travel in an upper limit constant speed state in which the speed is less than the lever constant speed state. This is achieved by operating the upper-limit setting device 35 so that the upper limit speed becomes less than the lever-set speed. In the upper limit constant speed state, it is possible to return to the lever constant speed state in a simple manner by operating the upper-limit setting device 35 so that the upper limit speed becomes greater than the lever-set speed.

In other words, the constant-speed rotation can be finely adjusted by operating the upper-limit setting device 35 based on the lever-set speed. As a result, a constant-speed rotation setting that corresponds to the field conditions or the like can easily be changed.

The accelerator lever 33 can be set to the idling position, and the upper-limit setting device 35 can be operated so that the upper limit speed is an engine speed suitable for work, whereby the vehicle body can be made to travel in an upper limit constant speed state at which the output speed of the engine 1 is maintained at an upper limit speed suitable for work. This is achieved by depressing the accelerator pedal 31 to the operation limit position. In the upper limit constant speed state, the vehicle body can be made to travel in a pedal deceleration state in which the output speed of the engine 1 is brought below the upper limit speed by letting up on the depression of the accelerator pedal 31 so that the pedal-set speed is brought below the upper limit speed. In the pedal deceleration state, it is possible to return to the upper limit constant speed state by again depressing the accelerator pedal 31 as far as the operation limit position.

When the upper-limit setting device 35 is thus operated so that the upper limit speed is an engine speed suitable for work, a constant speed state suitable for work can be stably obtained by operating the accelerator pedal 31, regardless of the shaking of the vehicle body caused by the roughness of the field and the like. This is achieved by depressing the accelerator pedal 31 to the operation limit position when traveling forward during work. In the case of making a headland turn, a deceleration state suitable for a headland turn can be easily achieved by reducing the operation of the accelerator pedal 31 prior to initiating the headland turn. Also, when slippage occurs in a constant speed state, it is possible to reduce the amount of slippage, increase the gripping force, and escape from the slippage state in a simple manner by letting up on the depression of the accelerator pedal 31 and reducing the engine speed. A constant speed state suitable for work can easily be reproduced by depressing the accelerator pedal 31 to the operation limit position after a headland turn or after escaping from the slippage state.

In other words, it is possible to easily maintain a travel state suitable for turnaround work in which forward travel and headland turning is repeated, or to obtain a travel state suitable for heavy towing work in which a plow, subsoiler, or another readily slipping implement is connected.

The controller 21 has a first stored speed that is read based on the operation of the first switch 37 composed of a momentary switch disposed on the right side of the driver's seat 7, and a second stored speed that is read based on the operation of the second switch 38 composed of a momentary switch disposed adjacent to the first switch 37.

The target speed setting unit 55 essentially sets the first stored speed to a target speed on the basis of the output of the first switch 37 when the first switch 37 is operated in the lever constant speed state in which the accelerator lever 33 is moved to an operative position in which the output speed of the engine 1 becomes greater than the idling speed. In a state in which the first stored speed is set to the target speed, the time until the first switch 37 returns to the initial position is measured when the first switch 37 is operated, and as long as the measured time is within a set time (e.g., within three seconds), the pedal-set speed, the lever-set speed, and the upper limit speed are compared based on the output of the first switch 37 at that time, and the higher speed among the pedal-set speed and the lever-set speed is set as the target speed in the case that the pedal-set speed and the lever-set speed are less than the upper limit speed. The upper limit speed is set as the target speed when one speed among the pedal-set speed and the lever-set speed is greater than the upper limit speed.

The second stored speed is set to the target speed on the basis of the output of the second switch 38 when the second switch 38 is operated in a lever constant speed state in which the accelerator lever 33 is moved to an operative position in which the output speed of the engine 1 becomes greater the idling speed. In a state in which the second stored speed is set to the target speed, the time until the second switch 38 returns to the initial position is measured when the second switch 38 is operated, and as long as the measured time is within a set time (e.g., within three seconds), the pedal-set speed, the lever-set speed, and the upper limit speed are compared based on the output of the second switch 38 at that time, and the higher speed among the pedal-set speed and the lever-set speed is set as the target speed in the case that the pedal-set speed and the lever-set speed are less than the upper limit speed. The upper limit speed is set as the target speed when one speed among the pedal-set speed and the lever-set speed is greater than the upper limit speed.

In other words, the engine speed control means 50 sets the first stored speed to the target speed when the first switch 37 is operated in the lever constant speed state, and the first constant speed control is carried out to control the output speed of the engine 1 so that the first stored speed is obtained as the output speed of the engine 1. The second stored speed is set as the target speed when the second switch 38 is operated in the lever constant speed state, and the second constant speed control is carried out to control the output speed of the engine 1 so that the second stored speed is obtained as the output speed of the engine 1.

In the case that the first switch 37 is briefly pressed so that the measurement time until the return of the first switch 37 to the initial position is within a set time during execution of the first constant speed control, the first constant speed control is ended and one type of control among the foot accelerator control, hand accelerator control, and upper limit rotation control is carried out based on the target speed that is set in accordance with the operative state at that time. In the case that the second switch 38 is briefly pressed so that the measurement time until the return of the second switch 38 to the initial position is within a set time during execution of the second constant speed control, the second constant speed control is ended and one type of control among the foot accelerator control, hand accelerator control, and upper limit rotation control is carried out based on the target speed that is set in accordance with the operative state at that time.

In accordance with this configuration, as long as the first stored speed is set to the engine speed suitable for tilling work, and the second stored speed is set to the engine speed suitable for puddling work, the vehicle body can be made to travel in a constant speed state (hereinafter referred to as "first stored constant speed state") for maintaining the output speed of the engine 1 at the first stored speed suitable for tilling work. This is achieved by operating the first switch 37 after the accelerator lever 33 has been moved to the operative position in which the output speed of the engine 1 becomes greater than the idling speed. Also, the vehicle body can be made to travel in a constant speed state (hereinafter referred to as "second stored constant speed state") for maintaining the output speed of the engine 1 at the second stored speed suitable for puddling work. This is achieved by operating the second switch 38 after the accelerator lever 33 has been moved to the operative position in which the output speed of the engine 1 becomes greater than the idling speed.

The accelerator lever 33 is operated so that the lever-set speed becomes the engine speed suitable for headland turning, whereupon a deceleration state (hereinafter referred to as "lever deceleration state") that is induced by an accelerator lever 33 and is suitable for headland turning can be easily achieved by briefly pressing the first switch 37 prior to initiating the headland turning in the first stored constant speed state, and the first stored constant speed state suitable for tilling work can be easily reproduced by operating the first switch 37 immediately prior to the end of headland turning or after headland turning has ended. In the second stored constant speed state, the lever deceleration state can be easily achieved by briefly pressing the second switch 38 prior to initiating a headland turn. And the second stored constant speed state suitable for puddling work can be easily reproduced by operating the second switch 38 immediately prior to the end of headland tuning or after headland turning has ended.

Also, a configuration is used in which constant speed control is carried out on the basis of the operation of the first switch 37 or the second switch 38 only in the case in which the accelerator lever 33 has been moved to an operative position in which the output speed of the engine 1 becomes greater than the idling speed, whereby the engine speed control means 50 does not carry out constant speed control due to the above operation even if the first switch 37 or the second switch 38 is operated in a stopped vehicle state in which power transmission from the engine 1 is cut off and the accelerator lever 33 is positioned in the idling position. Therefore, the output speed of the engine 1 does not increase unnecessarily due to operation of the first switch 37 or the second switch 38 in a stopped vehicle state.

The engine speed control means 50 transitions from the first constant speed control to the second constant speed control when the second switch 38 is operated during the execution of the first constant speed control; and transitions from the second constant speed control to the first constant speed control when the first switch 37 is operated during the execution of the second constant speed control.

In accordance with this configuration, as long as the first stored speed is set to an engine speed suitable for work and the second stored speed is set to an engine speed suitable for headland turning, the vehicle body can be made to travel in the first stored constant speed state suitable for work by operating the first switch 37 after the accelerator lever 33 has been moved to an operative position in which the output speed of the engine 1 becomes greater than the idling speed. The second stored constant speed state suitable for headland turning can be easily achieved by operating the second switch 38 prior to initiating a headland turn, and the first stored constant speed state suitable for work can be easily reproduced by operating the first switch 37 immediately prior to the end of headland turning or after headland turning has been completed.

The engine speed control means 50 carries out foot accelerator control with priority given to first constant speed control when the pedal-set speed becomes greater than the first constant speed control during execution of the first constant speed control. The foot accelerator control is ended and the first constant speed control is restarted when the pedal-set speed becomes less than the first stored speed during priority execution of the foot accelerator control. The foot accelerator control is carried out with priority given to the second constant speed control when the pedal-set speed becomes greater than a the second stored speed during execution of the second constant speed control. The foot accelerator control is ended and the first constant speed control is restarted when the pedal-set speed becomes less than the first stored speed during priority execution of the foot accelerator control.

In accordance with this configuration, in the first stored constant speed state, the accelerator pedal 31 is operated so that the pedal-set speed becomes greater than the first stored speed, whereby the vehicle body can be made to travel in a pedal acceleration state in which the output speed of the engine 1 is increased from the first stored speed to the pedal-set speed during the interval in which the above operation is carried out. In the pedal acceleration state, the vehicle body can be made to travel in an upper limit constant speed state, which limits the output speed of the engine 1 to the upper limit speed, when the pedal-set speed becomes greater than the upper limit speed. It is possible to return to the first stored constant speed state by cancelling the operation of the accelerator pedal 31.

In the second stored constant speed state, the accelerator pedal 31 is operated so that the pedal-set speed becomes greater than the second stored speed, whereby the vehicle body can be made to travel in a pedal acceleration state in which the output speed of the engine 1 is increased from the second stored speed to the pedal-set speed during the interval in which the above operation is carried out. In the pedal acceleration state, the vehicle body can be made to travel in an upper limit constant speed state, which limits the output speed of the engine 1 to the upper limit speed, when the pedal-set speed becomes greater than the upper limit speed. It is possible to return to the second stored constant speed state by cancelling the operation of the accelerator pedal 31.

When the lever-set speed is reduced to an idling speed during execution of the first constant speed control, the engine speed control means 50 ends the first constant speed control and carries out one type of control among the foot accelerator control the hand accelerator control, and the upper limit rotation control on the basis of the target speed set in accordance with the operational state at that time. When the lever-set speed is reduced to an idling speed during execution of the second constant speed control, the second constant speed control is ended and one type of control among the foot accelerator control, the hand accelerator control, and the upper limit rotation control is carried out on the basis of the target speed set in accordance with the operational state at that time.

In accordance with this configuration, in the constant speed state in which the output speed of the engine 1 is maintained at the first stored speed or the second stored speed, the accelerator lever 33 is operated so that the lever-set speed is made equal to or less than the idling speed, whereby a deceleration state in which the output speed of the engine 1 is reduced to the idling speed or less can be established as long as the accelerator pedal 31 is not operated.

In other words, in a stored constant speed state in which the output speed of the engine 1 is kept at the first stored speed or at the second stored speed, the vehicle speed can be reduced using a familiar operation in that the accelerator lever 33 is operated in the deceleration direction in the same manner as during the deceleration operation in the lever constant speed state in the case that a need to decelerate has arisen.

When the lever-set speed becomes greater the first stored speed during execution of the first constant speed control, the engine speed control means 50 ends the first constant speed control and carries out one type of control among the foot accelerator control, the hand accelerator control, and the upper limit rotation control on the basis of the target speed set in accordance with the operational state at that time. When the lever-set speed becomes greater than the second stored speed during execution of the second constant speed control, the second constant speed control is ended and one type of control among the foot accelerator control, the hand accelerator control, and the upper limit rotation control is carried out on the basis of the target speed set in accordance with the operational state at that time.

In accordance with this configuration, in the case that the lever-set speed is equal to or less than the first stored speed in the first stored constant speed state, the vehicle body can be made to travel in a state of acceleration in which the output speed of the engine 1 is increased to the upper limit speed or the lever-set speed greater than the first stored speed by operating the accelerator lever 33 so that the lever-set speed is made to be greater than the first stored speed, and the vehicle body can be made to travel at a constant speed achieved after the acceleration.

Also, when the lever-set speed is equal to or less than the second stored speed in the second stored constant speed state, the vehicle body can be made to travel in a state of acceleration in which the output speed of the engine 1 is increased to the upper limit speed or the lever-set speed greater than the second stored speed by operating the accelerator lever 33 so that the lever-set speed is made to be greater than the second stored speed, and the vehicle body can be made to travel at a constant speed achieved after the acceleration.

In other words, in a constant speed state in which the output speed of the engine 1 is maintained at the first stored speed or the second stored speed, the vehicle speed can be increased and maintained using a familiar operation in which the accelerator lever 33 is operated in the acceleration direction in the same manner as during the acceleration operation in the lever constant speed state in the case that a need to accelerate has arisen.

The engine speed control means 50 carries out upper limit rotation control with priority given to first constant speed control when the upper limit speed becomes less than the first stored speed during first constant speed control. The upper limit rotation control is ended and the first constant speed control is restarted when the upper limit speed becomes greater than the first stored speed during priority execution of the upper limit rotation control. The upper limit rotation control is carried out with priority given to second constant speed control when the upper limit speed becomes less than the second stored speed during execution of the second constant speed control. The upper limit rotation control is ended and the second constant speed control is restarted when the upper limit speed becomes greater than the second stored speed during priority execution of the upper limit rotation control.

In other words, in the first stored constant speed state, the vehicle body can be made to travel in an upper limit constant speed state in which the speed is less than the first stored constant speed state by operating the upper-limit setting device 35 so that the upper limit speed becomes less than the first stored speed. In the upper limit constant speed state, it is possible to return to the first stored constant speed state in a simple manner by operating the upper-limit setting device 35 so that the upper limit speed becomes greater than the first stored speed.

In the second stored constant speed state, the vehicle body can be made to travel in an upper limit constant speed state in which the speed is less than the second stored constant speed state by operating the upper-limit setting device 35 so that the upper limit speed becomes less than the second stored speed. In the upper limit constant speed state, it is possible to return to the second stored constant speed state in a simple manner by operating the upper-limit setting device 35 so that the upper limit speed becomes greater than the second stored speed.

In accordance with this configuration, the constant-speed rotation can be finely adjusted by operating the upper-limit setting device 35 based on the first stored speed or the second stored speed. As a result, the setting of the first stored speed or the second stored speed that corresponds to the field conditions or the like can easily be changed.

Also, it is possible to reduce the amount of slippage, increase the gripping force, and escape from a slippage state in a simple manner by operating the upper-limit setting device 35 so that the upper limit speed becomes less than the first stored speed in a case in which slippage occurs in the first stored constant speed state, and by operating the upper-limit setting device 35 so that the upper limit speed becomes less than the second stored speed in a case in which slippage occurs in the second stored constant speed state. It is possible to return to the first stored constant speed state or the second stored constant speed state, in which the output speed of the engine 1 is maintained at the first stored speed or the second stored speed, respectively, by operating the upper-limit setting device 35 so that the upper limit speed becomes greater than the first stored speed in the first stored constant speed state, or so that the upper limit speed becomes greater than the second stored speed in the second stored constant speed state after escaping from the slippage state.

The engine speed control means 50 transitions from the first constant speed control or the second constant speed control to one type of control among the foot accelerator control, the hand accelerator control, and the upper limit rotation control on the basis of the operation of the first switch 37 or the second switch 38, whereby the output speed of the engine 1 is controlled so that the variation in speed is reduced in comparison with the case in which the output speed of the engine 1 is reduced based on the operation of the first switch 37 or the second switch 38 when the output speed of the engine 1 increases.

Variation in the output speed when the output speed of the engine 1 is increased can thereby be smoothed in comparison with the case in which the output speed of the engine 1 is reduced. As a result, variation in speed during acceleration travel in which the output speed of the engine is increased can be smoothed in comparison with a deceleration travel process in which the output speed of the engine is reduced, and the riding comfort during acceleration travel can be further improved.

In the case that the first switch 37 is pressed for a long period so that the measurement time until the return of the first switch 37 to the initial position exceeds a set time during execution of the first constant speed control, the engine speed control means 50 transitions from the first constant speed control to the first stored speed change control for allowing the first stored speed setting to be changed based on the output of the first switch 37 at this time. In the case that the second switch 38 is pressed for a long period so that the measurement time until the return of the second switch 38 to the initial position exceeds a set time during execution of the second constant speed control, the engine speed control means 50 transitions from the second constant speed control to the second stored speed change control for allowing the second stored speed setting to be changed based on the output of the second switch 38 at this time.

When the first switch 37 is briefly pressed during the first stored speed variation control, the first stored speed is increased by an amount equal to a fixed speed (e.g., 10 rpm) on the basis of the output of the first switch 37 at that time. When the second switch 38 is briefly pressed, the first stored speed is reduced by an amount equal to a fixed speed (e.g., 10 rpm) on the basis of the output of the second switch 38 at that time. When the first switch 37 is pressed for a long period, the first stored speed is continuously increased during the interval in which the output is continuous (the interval in which the first switch 37 is pressed for a long period) on the basis of the output of the first switch 37 at that time. When the second switch 38 is pressed for a long period, the first stored speed is continuously reduced during the interval in which the output is continuous (the interval in which the second switch 38 is pressed for a long period) on the basis of the output of the second switch 38 at that time. In the case that neither the first switch 37 nor the second switch 38 has been operated during the setting time (e.g., three seconds), the speed at that stage is determined to be the first stored speed, and a transition is made from the first stored speed variation control to the first constant speed control.

When the first switch 37 is briefly pressed during the second stored speed variation control, the second stored speed is increased by an amount equal to a fixed speed (e.g., 10 rpm) on the basis of the output of the first switch 37 at that time. When the second switch 38 is briefly pressed, the second stored speed is reduced by an amount equal to a fixed speed (e.g., 10 rpm) on the basis of the output of the second switch 38 at that time. When the first switch 37 is pressed for a long period, the first stored speed is continuously increased during the interval in which the output is continuous (the interval in which the first switch 37 is pressed for a long period) on the basis of the output of the first switch 37 at that time. When the second switch 38 is pressed for a long period, the second stored speed is continuously reduced during the interval in which the output is continuous (the interval in which the second switch 38 is pressed for a long period) on the basis of the output of the second switch 38 at that time. In the case that neither the first switch 37 nor the second switch 38 has been operated during the setting time (e.g., three seconds), the speed at that stage is determined to be the second stored speed, and a transition is made from the second stored speed variation control to the second constant speed control.

In other words, the first switch 37 and the second switch 38 can be made to function as instruction means for issuing an instruction to execute the first constant speed control or the second constant speed control, instruction means for issuing an instruction to transition from the first constant speed control to the first stored speed variation control or issuing an instruction to transition from the second constant speed control or the second stored speed variation control, and a setting device for changing the setting of the first stored speed or the second stored speed. In comparison with the case in which operative devices that correspond to these functions are provided, costs can be cut and mounting space can be reduced.

In the power-on stage in which a key switch 39 is set in the on position, the engine speed control means 50 carries out first stored speed variation control when the first switch 37 has been pressed for a long period, and the second stored speed variation control is carried out when the second switch 38 has been pressed for a long period. The first stored speed or the second stored speed can be varied in accordance with the type of work or the like prior to starting the work.

Figure 4:
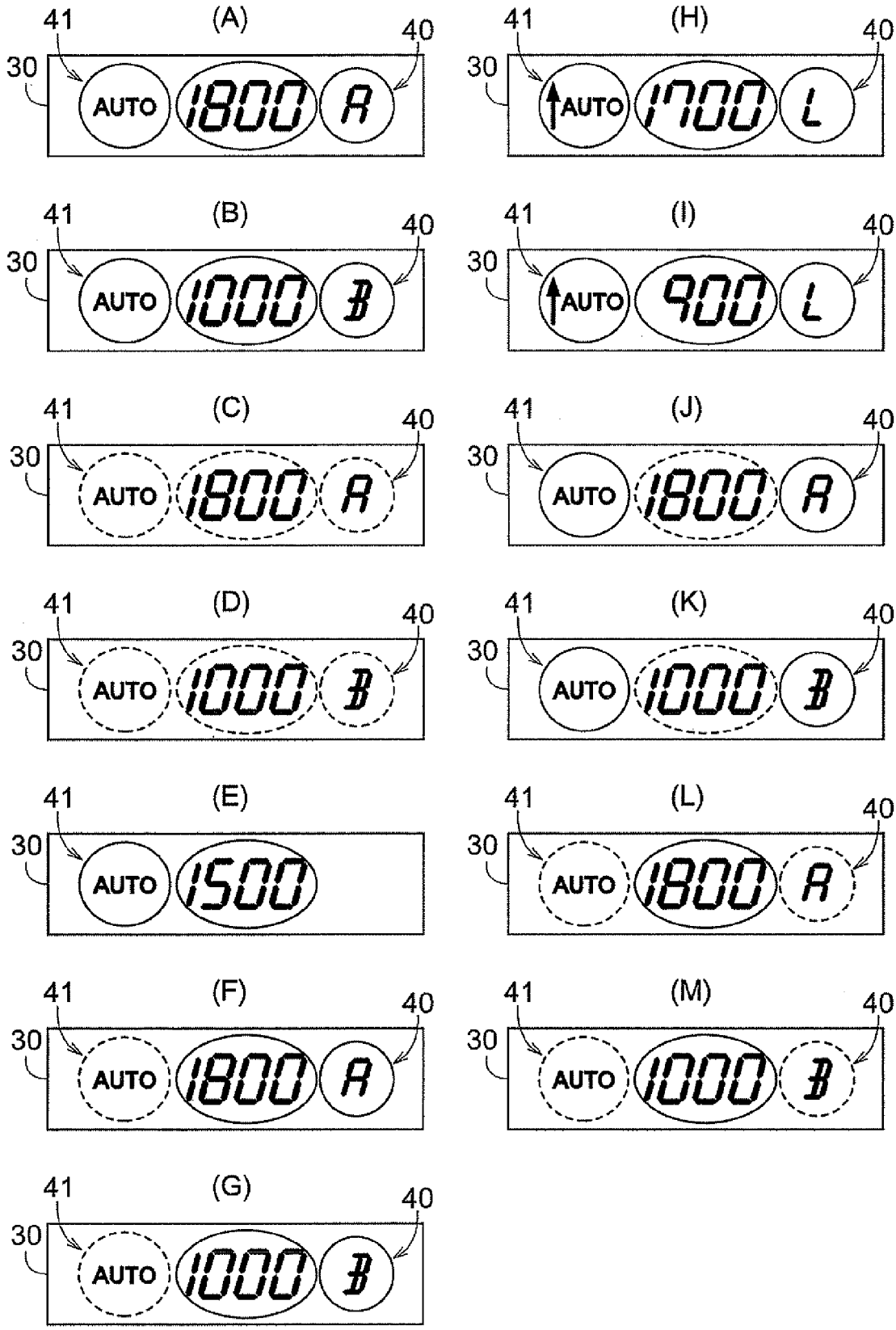
FIG. 4 is schematic diagram showing the display details switched using a liquid crystal device.

The engine speed control means 50 transmits display information to display control means 71 in accompaniment with the pressing operation when the first switch 37 is operated in a state in which the first constant speed control can be carried out, and sequentially displays on the liquid crystal display 30 the first stored speed ("1800" is shown as an example in this case), a first identification symbol 40 ("A" is shown as an example in this case) indicating the first stored speed, and a second identification symbol 41 ("AUTO" is shown as an example in this case) indicating the execution of the first constant speed control or the second constant speed control. FIG. 4 is schematic diagram showing the display details switchably displayed on a liquid crystal display. First, reference will be made to the screen diagram indicated by (A) in FIG. 4. Hereinbelow, the screen diagram showing sequentially switched display content is indicated by an alphabet letter in parentheses. The first constant speed control is initiated in accompaniment with the return of the first switch 37 to the initial position.

When the second switch 38 is operated in a state in which the second constant speed control can be carried out display information is transmitted to the display control means 71 in accompaniment with the pressing operation at that time, and the liquid crystal display 30 sequentially displays the second stored speed ("1000" is shown as an example in this case), a first identification symbol 40 ("B" is shown as an example in this case) indicating the second stored speed, and a second identification symbol 41 ("AUTO" is shown as an example in this case) indicating the execution of the first constant speed control or the second constant speed control (see (B) of FIG. 4). The second constant speed control is initiated in accompaniment with the return of the second switch 38 to the initial position.

In other words, the target speed and the like in the constant speed controls can be displayed on the liquid crystal display 30 and visually presented to the driver at a stage prior to the output speed of the engine 1 being changed in accompaniment with the start of the first constant speed control or the second constant speed control. This can be achieved without providing a dedicated display unit for displaying the first stored speed, the second stored speed, and the like. The display state of the liquid crystal display 30 switches to a state in which the target speed or the like in the first constant speed control or the second constant speed control is displayed in accompaniment with the operation of the first switch 37 or the second switch 38. Therefore, the information is more easily presented to the driver in comparison with the case in which the target speed or the like is constantly displayed as part of the first constant speed control or the second constant speed control.

The engine speed control means 50 intermittently displays (see (C) of FIG. 4) on the liquid crystal display 30 the first stored speed ("1800," in this case), a first identification symbol 40 ("A," in this case), and a second identification symbol 41 ("AUTO," in this case), when the first switch 37 has been operated in a state in which the accelerator lever 33 is positioned in an operative position in which the output speed of the engine 1 is equal to or less than the idling speed.

Also, the second stored speed ("1000," in this case), a first identification symbol 40 ("B," in this case), and a second identification symbol 41 ("AUTO," in this case) are intermittently displayed (see (D)) of FIG. 4) on the liquid crystal display 30 when the second switch 38 has been operated in a state in which the accelerator lever 33 is placed in an operative position in which the output speed of the engine 1 is equal to or less than the idling speed.

The fact that the first constant speed control or the second constant speed control will not be carried out can be visually presented to the driver regardless of the operation of the first switch 37 or the second switch 38 by placing the accelerator lever 33 in an operative position in which the output speed of the engine 1 is less than the idling speed.

When the first switch 37 is briefly pressed during execution of the first constant speed control in which the first stored speed is set to the target speed, the engine speed control means 50 transmits display information to the display control means 71 in accompaniment with pressing operation at that time; continuously displays on the liquid crystal display 30 the target speed ("1500" is shown as an example in this case) set in accordance with the operational state after completion of the first constant speed control, in place of the first stored speed; and ends display of the first identification symbol 40 (see (A) and (E) of FIG. 4). The first constant speed control is ended in accompaniment with the return of the first switch 37 to the initial position, and one type of control among the foot accelerator control, the hand accelerator control, and the upper limit rotation control that corresponds to the operational state at that time is started.

When the second switch 38 is briefly pressed during execution of the second constant speed control in which the second stored speed is set to the target speed, the display information is transmitted to the display control means 71 in accompaniment with the pressing operation at that time; the liquid crystal display 30 continuously displays, in place of the second stored speed, the target speed ("1500," in this case) set in accordance with the operational state after completion of the second constant speed control; and display of the first identification symbol 40 is ended (see (B) and (E) of FIG. 4). The second constant speed control is ended in accompaniment with the return of the second switch 38 to the initial position, and one type of control among the foot accelerator control, the hand accelerator control, and the upper limit rotation control that corresponds to the operational state at that time is started.

In other words, the target speed after completion of the first constant speed control or the second constant speed control is displayed on the liquid crystal display 30 and visually presented to the driver at a stage prior to the output speed of the engine 1 being changed in accompaniment with transition from the first constant speed control or the second constant speed control to the foot accelerator control, the hand accelerator control, or the upper limit rotation control.

When the second switch 38 is operated during execution of the first constant speed control, the engine speed control means 50 transmits the display information to the display control means 71 in accompaniment with the pressing operation at that time, continuously displays on the liquid crystal display 30 the second stored speed ("1000" is shown as an example in this case) in place of the first stored speed ("1800," in this case), and changes the first identification symbol 40 from one that shows the first stored speed ("A," in this case) to one that shows second stored speed ("B," in this case) (see (A) and (B) of FIG. 4). A transition is then made from the first constant speed control to the second constant speed control in accompaniment with the return of the second switch 38 to the initial position.

When the first switch 37 is operated during execution of the second constant speed control the display information is transmitted to the display control means 71 in accompaniment with the pressing operation at that time, the first stored speed ("1800," in this case) is continuously displayed on the liquid crystal display 30 in place of the second stored speed ("1000," in this case), and the first identification symbol 40 is changed (see (B) and (A) of FIG. 4) from one that shows the second stored speed ("B," in this case) to one that shows first stored speed ("A," in this case). A transition is then made from the second constant speed control to the first constant speed control in accompaniment with the return of the first switch 37 to the initial position.

In other words, the post-transition target speed in the first constant speed control or the second constant speed control can be displayed on the liquid crystal display 30 and visually presented to the driver at a stage prior to the output speed of the engine 1 being changed in accompaniment with transition from the first constant speed control to the second constant speed control or from the second constant speed control to the first constant speed control.

The engine speed control means 50 carries out foot accelerator control with priority given to the first constant speed control when the pedal-set speed becomes greater than the first stored speed during execution of the first constant speed control, transmits display information to the display control means 71, and changes display of the second identification symbol 41 ("AUTO," in this case) from a continuous display to an intermittent display (see (A) and (F) of FIG. 4).

When the pedal-set speed becomes less than the first stored speed during priority execution of the foot accelerator control, the foot accelerator control is ended, the first constant speed control is restarted, the display information is transmitted to the display control means 71, and display of the second identification symbol 41 ("AUTO," in this case) on the liquid crystal display 30 is changed from an intermittent display to a continuous display (see (F) and (A) of FIG. 4).

When the pedal-set speed becomes greater than the second stored speed during execution of the second constant speed control, the foot accelerator control is carried out with priority given to the second constant speed control, the display information is transmitted to the display control means 71, and display of the second identification symbol 41 ("AUTO," in this case) on the liquid crystal display 30 is changed from a continuous display to an intermittent display (see (B) and (G) of FIG. 4).

When the pedal-set speed becomes less than the second stored speed during priority execution of the foot accelerator control, the foot accelerator control is ended, the second constant speed control is restarted, the display information is transmitted to the display control means 71, and display of the second identification symbol 41 ("AUTO," in this case) on the liquid crystal display 30 is changed from an intermittent display to a continuous display (see (G) and (B) of FIG. 4).

In other words, in the case that a transition is made from the first constant speed control or the second constant speed control to the foot accelerator control by operating the accelerator pedal 31 during execution of the first constant speed control or the second constant speed control, the second identification symbol 41 is intermittently displayed while the first stored speed or the second stored speed, as well as the first identification symbol 40 that indicates the stored speed, are continuously displayed on the liquid crystal monitor 30, whereby the transition from the first constant speed control or the second constant speed control to the foot accelerator control can be visually presented to the driver. Also, in the case that the first constant speed control or the second constant speed control is to be restarted by operating the accelerator pedal 31 during priority execution of the foot accelerator control, the first stored speed or the second stored speed, as well as the first identification symbol 40 and the second identification symbol 41 that correspond to the stored speed, are continuously displayed on the liquid crystal display 30, whereby the driver can be made visually aware of the restart of the first constant speed control or the second constant speed control, and of the target speed in the restarted first constant speed control or second constant speed control.

The engine speed following transition to the foot accelerator control can be visually presented using a tachometer.

When the upper limit speed becomes less than the first stored speed during execution of the first constant speed control, the engine speed control means 50 carries out the upper limit rotation control with priority given to the first constant speed control, transmits the display information to the display control means 71, continuously displays on the liquid crystal display 30 the upper limit speed ("1700" is shown as an example in this case) in place of the first stored speed ("1800," in this case), changes the first identification symbol 40 from one ("A," in this case) showing the first stored speed to one ("L," in this case) showing the upper limit speed, and changes the second identification symbol 41 from one ("AUTO," in this case) showing the execution of the first constant speed control or the second constant speed control to one ("AUTO," in this case) showing the priority execution of the upper limit rotation control (see (A) and (H) of FIG. 4).

When the upper limit speed becomes greater than the first stored speed during priority execution of the upper limit rotation control, the upper limit rotation control is ended, the first constant speed control is restarted, the display information is transmitted to the display control means 71, the first stored speed ("1800," in this case) is continuously displayed on the liquid crystal display 30 in place of the upper limit speed ("1700," in this case), the first identification symbol 40 is changed from one ("L," in this case) showing the upper limit rotational control to one ("A," in this case) showing the first stored speed, and the second identification symbol 41 is changed from one ("AUTO," in this case) showing the priority execution of the upper limit rotation control to one ("AUTO," in this case) showing the execution of the first constant speed control or the second constant speed control (see (H) and (A) of FIG. 4).

When the upper limit speed becomes less than the second stored speed during execution of the second constant speed control, the upper limit rotation control is earned out with priority given to the second constant speed control, the display information is transmitted to the display control means 71, the upper limit speed ("900" is shown as an example in this case) is continuously displayed on the liquid crystal display 30 in place of the second stored speed ("1000," in this case), the first identification symbol 40 is changed from one ("B," in this case) showing the second stored speed to one ("L," in this case) showing the upper limit speed and the second identification symbol 41 is changed from one ("AUTO," in this case) showing the execution of the first constant speed control or the second constant speed control to one ("AUTO," in this case) showing the priority execution of the upper limit rotation control (see (B) and (I) of FIG. 4).

When the upper limit speed becomes greater than the second stored speed during priority execution of the upper limit rotation control, the upper limit rotation control is ended, the second constant speed control is restarted, the display information is transmitted to the display control means 71, the second stored speed ("1000," in this case) is continuously displayed on the liquid crystal display 30 in place of the upper limit speed ("900," in this case), the first identification symbol 40 is changed from one ("L," in this case) showing the upper limit rotational control to one ("B," in this case) showing the second stored speed, and the second identification symbol 41 is changed from one ("AUTO," in this case) showing the priority execution of the upper limit rotation control to one ("AUTO," in this case) showing the execution of the first constant speed control or the second constant speed control (see (I) and (B) of FIG. 4).

In other words, the upper limit speed, the first identification symbol 40 showing the upper limit speed, and the second identification symbol 41 showing the priority execution of the upper limit rotation control are continuously displayed on the liquid crystal display 30 in the case that a transition is made from the first constant speed control or the second constant speed control to the upper limit rotation control by operating the upper-limit setting device 35 during execution of the first constant speed control or the second constant speed control, whereby the driver can be made visually aware of the transition to the upper limit rotation control and the output speed of the engine 1 at that time. Also, the first stored speed or the second stored speed, the first identification symbol 40 showing the stored speed, and the second identification symbol 41 showing the execution of the first constant speed control or the second constant speed control are continuously displayed in the case that the first constant speed control or the second constant speed control is restarted by operating the upper-limit setting device 35 during priority execution of the upper limit rotation control, whereby the driver can be made visually aware of the restart of the first constant speed control or the second constant speed control, and of the target speed in the restarted first constant speed control or the second constant speed control.

When the first switch 37 is operated in the case that the upper limit speed is less than the first stored speed or in the case that the pedal-set speed is greater than the first stored speed, the engine speed control means 50 transmits the display information to the display control means 71 in accompaniment with the operation, intermittently displays the first stored speed ("1800," in his case) on the liquid crystal display 30, and continuously displays (see (J) of FIG. 4) the first identification symbol 40 ("A," in this case) and the second identification symbol 41 ("AUTO," in this case).

When the second switch 38 is operated in the case that the upper limit speed is less than the second stored speed or in the case that the pedal-set speed is greater than the second stored speed, the display information is transmitted to the display control means 71 in accompaniment with the operation, the second stored speed ("1000," in this case) is intermittently displayed on the liquid crystal display 30, and the first identification symbol 40 ("B," in this case) and the second identification symbol 41 ("AUTO," in this case) are continuously displayed (see (K) of FIG. 4) on the display.

The driver can be visually made aware of the fact that the first constant speed control or the second constant speed control are not being carried out regardless of the operation of the first switch 37 or the second switch 38 because of the operative position of the accelerator pedal 31 or the upper-limit setting device 35.

When the first switch 37 is pressed for a long period during execution of the first constant speed control, the engine speed control means 50 makes a transition from the first constant speed control to the first stored speed variation control, transmits the display information to the display control means 71, and changes the display of the first identification symbol 40 ("A," in this case) and the second identification symbol 41 ("AUTO," in this case) from a continuous display to an intermittent display on the liquid crystal display 30 (see (A) and (L) of FIG. 4).

When the second switch 38 is pressed for a long period during execution of the second constant speed control, a transition is made from the second constant speed control to the second stored speed variation control, the display information is transmitted to the display control means 71, and the display of the first identification symbol 40 ("B," in this case) and the second identification symbol 41 ("AUTO," in this case) is changed from continuous display to intermittent display on the liquid crystal display 30 (see (B) and (M) of FIG. 4).

A transition can thereby be made from the first constant speed control or the second constant speed control to the first stored speed or the second stored speed, and the driver can be visually presented with the fact that the setting of the first stored speed or the second stored speed can be changed by operating the first switch 37 or the second switch 38.

When the first switch 37 or the second switch 38 is operated during execution of the first stored speed variation control or the second stored speed variation control, the engine speed control means 50 modifies the first stored speed or the second stored speed, transmits the display information to the display control means 71, and continuously displays the first stored speed or the second stored speed on the liquid crystal display 30 following the modification. The modification of the setting of the first stored speed or the second stored speed can be carried out while viewing the modification by operating the first switch 37 or the second switch 38.

When a display switch 42 disposed in the passenger/driver section 8 is operated, the engine speed control means 50 transmits the display information to the display control means 71, and the information displayed on the liquid crystal display 30 is switched in each setting period (e.g., one second) between, first, a state in which the first stored speed ("1800," in this case), the first identification symbol 40 ("A," in this case), and the second identification symbol 41 ("AUTO," in this case) are continuously displayed, and, second, a state in which the second stored speed ("1000," in this case), the first identification symbol 40 ("B," in this case), and the second identification symbol 41 ("AUTO," in this case) are continuously displayed.

Various control programs, map data, the first stored speed, second stored speed, and the like are stored in storage means 56 composed of an EEPROM, flash memory, or another non-volatile memory provided to the controller 21.

[Other Embodiments]

[1] The work vehicle may be a riding-type mower vehicle, a riding-type rice-transplanting vehicle, a combine, a wheel dozer, or the like.

[2] The implement mounted on the tractor may be a front loader, a grooving device, a ridge-plastering device, or the like.

[3] The engine 1 may be a diesel engine or a gasoline engine.

[4] The fuel injection control means 16A and the controller 21 may be integrally configured.

[5] The switches 37 and 38 may be configured using a neutral return-type single switch provided with first and second contact points.

In this configuration, the operation of closing the first contact point of the switch may be set to be an operation for issuing an instruction to execute the constant speed control, and the operation of closing the second contact point may be set to be an operation that is different from the operation for issuing an instruction to execute the stored speed change control. It is also possible to set the operation of briefly closing the first contact point within a set period of time to be an operation for issuing an instruction to execute the first constant speed control, the operation of briefly closing the second contact point within a set period of time to be an operation for issuing an instruction to execute the second constant speed control, the operation of closing the first contact point for a long period when a set time has been exceeded to be an operation that is different from the operation for issuing an instruction to execute the first stored speed change control, and the operation of closing the second contact point for a long period when a set time has been exceeded to be an operation that is different from the operation for issuing an instruction to execute the second stored speed change control.

[6] A single stored speed may be stored, or three or more stored speeds may be stored in the storage means 56.

In the case that a single stored speed is stored in the storage means 56, it will be sufficient merely for a single input device 37 to be provided. In the case that the momentary switch 37 is provided as the single input device 37, the engine speed control means 50 may be configured so that pressing the momentary switch 37 briefly during execution of the stored speed change control will prompt a change in the direction toward increasing the engine speed stored in the storage means 56 by a predetermined amount; and that pressing the momentary switch 37 for a long period will prompt a change in the direction toward reducing the engine speed stored in the storage means 56 by a predetermined amount.

[7] A dedicated operative device changing the stored speed may be provided.

What is claimed is:

1. An engine speed control system for a work vehicle, comprising:

storage means for storing a predetermined engine speed;

a manually operated input device for issuing an instruction to retrieve the engine speed from the storage means; and engine speed control means for executing a constant speed control whereby the engine speed stored in the storage means is set as a target speed on the basis of a first input operation made using the input device;

wherein the engine speed control means executes a stored speed change control for allowing the setting of the engine speed stored in the storage means to be changed on the basis of a second input operation performed using the input device, the second input operation differing from the first input operation.

2. The engine speed control system as defined in claim 1, wherein in the stored speed change control, the engine speed control means changes the engine speed stored in the storage means on the basis of operation of the input device.

3. The engine speed control system as defined in claim 2, wherein the input device comprises a first momentary switch and a second momentary switch;

a first engine speed corresponding to the first momentary switch and a second engine speed corresponding to the second momentary switch are stored in the storage means;

the first input operation is a brief pressing of the momentary switch within a set period of time, and the second input operation is a long pressing of the momentary switch that exceeds the set period of time; and the engine speed control means executes the controls described below:

(1) as the constant speed control, a first constant speed control for setting the first engine speed to a target engine speed on the basis of the brief pressing of the first momentary switch;

(2) as the constant speed control, a second constant speed control for setting the second engine speed to a target engine speed on the basis of the brief pressing of the second momentary switch;

(3) as the stored speed change control, a first stored speed change control for allowing the setting of the first engine speed stored in the storage means (56) to be changed on the basis of the long pressing of the first momentary switch;

(4) as the stored speed change control, a second stored speed change control for allowing the setting of the second engine speed stored in the storage means to be changed on the basis of the long pressing of the second momentary switch; and wherein in either of the first stored speed change control or the second stored speed change control, the engine speed control means (50) increases the associated target engine speed on the basis of the operation of the first momentary switch, and reduces the associated target engine speed on the basis of the operation of the second momentary switch.

4. The engine speed control system as defined in claim 3, wherein in either of the first stored speed change control or the second stored speed change control:

when the first momentary switch is briefly pressed, the engine speed control means increases the associated target engine speed by a predetermined amount;

when the second momentary switch is briefly pressed, the engine speed control means reduces the associated target engine speed by a predetermined amount;

when the first momentary switch is pressed for a long period, the engine speed control means continuously increases the associated target engine speed over the period that the operation is uninterruptedly performed; and when the second momentary switch is pressed for a long period, the engine speed control means continuously reduces the associated target engine speed over the period that the operation is uninterruptedly performed.

5. The engine speed control system as defined in claim 1, wherein a control whereby the engine speed stored in the storage means is set as the target speed is carried out in a case that the engine speed stored in the storage means is less than an upper limit speed set in advance; and a control whereby the upper limit speed is set as the target speed is carried out in a case that the engine speed stored in the storage means is greater than the upper limit speed.

* * * * *